US009462833B1

(12) United States Patent
Spaulding

(10) Patent No.: US 9,462,833 B1
(45) Date of Patent: Oct. 11, 2016

(54) INTERCHANGEABLE AND ADJUSTABLE BIKINI ATTACHMENT AND CLOSURE SYSTEM

(71) Applicant: Erin Marie Spaulding, Manhattan Beach, CA (US)

(72) Inventor: Erin Marie Spaulding, Manhattan Beach, CA (US)

(73) Assignee: BALI KINI CO., Manhattan Beach, CA (US)

( * ) Notice: Subject to any disclaimer, the term of this patent is extended or adjusted under 35 U.S.C. 154(b) by 0 days.

(21) Appl. No.: 14/880,020

(22) Filed: Oct. 9, 2015

Related U.S. Application Data

(60) Provisional application No. 62/063,538, filed on Oct. 14, 2014, provisional application No. 62/092,364, filed on Dec. 16, 2014.

(51) Int. Cl.
*A41C 3/00* (2006.01)
*A41D 7/00* (2006.01)
*A41C 3/12* (2006.01)

(52) U.S. Cl.
CPC ..... *A41C 3/0028* (2013.01); *A41C 3/12* (2013.01); *A41D 7/005* (2013.01)

(58) Field of Classification Search
CPC ..... A41C 3/00–3/148; A41D 7/005
See application file for complete search history.

(56) References Cited

U.S. PATENT DOCUMENTS 3,311,112 A * 3/1967 Murray ..... A41F 1/006 450/1
4,411,269 A * 10/1983 Weintraub ..... A41C 3/02 450/58
4,988,338 A 1/1991 Taylor
6,186,861 B1 * 2/2001 Flaherty ..... A41F 15/002 450/1
6,715,186 B1 * 4/2004 Huang ..... A41B 9/002 2/271
8,337,275 B2 * 12/2012 Martins-Crawbuck A41C 3/0028 450/62
8,827,766 B2 9/2014 Lin
2003/0003844 A1 * 1/2003 Jones ..... A41F 15/002 450/88
2003/0236054 A1 * 12/2003 Chen ..... A41C 3/02 450/82
2005/0034207 A1 2/2005 Liddell
2006/0003669 A1 * 1/2006 Li ..... A41C 3/02 450/58
2007/0123148 A1 * 5/2007 Heer ..... A41C 3/06 450/77
2008/0098503 A1 5/2008 Swartz
2009/0075562 A1 * 3/2009 Lung ..... A41C 3/0071 450/58
2009/0235424 A1 * 9/2009 Carey ..... A41F 15/02 2/67
2009/0258572 A1 * 10/2009 Chayo ..... A41C 3/0028 450/39
2011/0289646 A1 12/2011 Scozzafava (Continued)

FOREIGN PATENT DOCUMENTS

| | | |
|---|---|---|
| CA | 2837890 | 1/2013 |
| CN | 203424393 | 2/2014 |
| GB | 2480810 | 12/2011 |
| WO | WO 2011/059467 | 5/2011 |
| WO | WO 2013/019909 | 2/2013 |

*Primary Examiner* — Khaled Annis
(74) *Attorney, Agent, or Firm* — Cislo & Thomas, LLP

(57) ABSTRACT

An interchangeable and adjustable bikini attachment and closure system that hides from view undesirable mechanical elements of bikini and bra-like articles of apparel, reduces material and garment waste, and provides a versatile, cost-effective solution for creating multiple swimwear "looks" without purchasing full sets or pieces of swimwear each season. The modular swimwear system uses novel closure and attachment mechanisms in the form of unique connector elements for both bikini tops and bikini bottoms to accomplish its interchangeable and versatile features.

10 Claims, 10 Drawing Sheets

(56) References Cited

U.S. PATENT DOCUMENTS

2012/0135667 A1* 5/2012 Chan ..... A41C 3/0092 450/58
2012/0272427 A1 11/2012 Scozzafava
2014/0364036 A1* 12/2014 Abbaszadeh ..... A61M 1/062 450/36

* cited by examiner

INTERCHANGEABLE AND ADJUSTABLE BIKINI ATTACHMENT AND CLOSURE SYSTEM

CROSS-REFERENCE TO RELATED APPLICATIONS

This patent application claims the benefit of U.S. Provisional Patent Application Ser. No. 62/063,538 entitled "Apparel (swimwear, activewear, footwear) completed by an interchangeable closure system (either by hook-and-loop or buckle) for interchangeable design elements to be added/subtracted, or exchanged entirely, and where article of apparel is rendered incomplete and un-wearable without one of unlimited form of datable design elements" filed Oct. 14, 2014 and U.S. Provisional Patent Application Ser. No. 62/092,364, entitled "A Means of Adjusting Size and Fit for Backless and Modular Bras or Swimwear Tops," filed Dec. 16, 2014 and which applications are incorporated in their entirety here by this reference.

TECHNICAL FIELD

This invention relates to the field of connectors generally and the related aspect of interchangable components of female apparel, and more specifically, the invention described herein pertains to the use of modular components in bikini and/or bra design comprising closure elements and adjustment systems for bra and or female swimwear components for the purpose of hiding of undesirable visible connection elements and reducing manufacturer's waste.

BACKGROUND

Apparel requires large quantities of materials to be used for manufacture of a static form, which may not be salable once manufactured due to the rapidly changing demands of the fashion industry. More specifically, fashion trends related to female swimwear (i.e., bikinis) and female undergarments (i.e., bras), also evolve rapidly. A manufacturer of bikinis and bras typically purchases and makes a substantial number of units of such articles designed and styled for purposes of sale during a particular season, and once the season is over and/or trends changes, manufacturers and re-sellers are left with unsold units of bras and bikinis having designs that are no longer desirable, and thus, many of the bras and bikinis made, or the fabric designs for the bras and bikinis goes to waste. Thus, it would be desirable to develop a system for designing and marketing bras and bikinis that would tend to reduce waste when fashion tastes change.

For swimwear especially, considered to be seasonal apparel, buying new sets each season can become costly. To have interchangeable parts for swimwear that provide different design elements for swimwear provides a versatile, cost-effective solution for creating multiple swimwear "looks" without purchasing full sets or pieces of swimwear each season.

A modular swimwear system completed by the connector elements described herein allows for manufactured swim apparel to no longer be fully wasted if unsalable, as the apparel becomes dynamic and changeable with the changing of any or all straps that hold the article onto the part of the body to be covered. If a certain base piece or articulating closure piece is unsalable, only that separate piece will be destroyed or sold at a potential loss, which lowers rate of waste or lost profits.

The invention described herein solves the above-referenced problem by creating a modular bikini and bra attachment, closure, and adjustment system wherein because, for example, bikinis are sold in their component parts (uppers, lowers (front and back), and connecting devices such as straps). If trends change, the connecting devices, at a minimum can be saved, and the uppers and lowers can be re-purposed for use in conjunction with other, more trendy uppers and/or lowers, where possible, thus, reducing garment waste.

Another issue with bikinis and female undergarments is that they typically show the mechanical closure details that are often not aesthetically pleasing. The mechanical closure details involve adjustment mechanisms with undesirable visible connections. For most bras, the closure and adjustment function is the same—a series of unsightly bent-wire bra loops that, when not attached to the hook at the tightest setting, are visible. In swimwear, tops either are tied on, or have similarly unsightly bra-type closure and adjustment mechanisms. Traditional unsightly bra mechanisms either expose the unattractive bent-wire hooks, or place the back articulation askew from the center of the back—both of which are undesirable attributes of traditional bras and bra-styled swim tops. Tie-on swim tops may provide for enhanced adjustability, but dangling tie ends lack the clean and finished look that many women desire.

For the foregoing reasons, there is a need for an interchangeable and adjustable bra or bikini attachment and closure system that is modular, hides the unsightly mechanical details used for size adjustment, and provides better display of the desired visual elements of a bra or bikini set.

SUMMARY OF THE INVENTION

The present invention is directed to an interchangeable and adjustable bikini attachment and closure system, especially for swimwear, which hides the unsightly mechanical elements used for size adjustment, and provides for better display of the desired visual elements of a bra or bikini, as well as provides interchangeable parts for more variety in wear. The interchangeable and adjustable bra attachments and closure system not only provides an aesthetic component but also a useful interchangeable aspect that is cost-effective.

The invention described herein relates to an interchangeable and adjustable bikini attachment and closure system designed to allow for flexibility in design, reduction of garment waste by manufacturers and re-sellers, wherein the system is designed to hide unattractive aspects of typical bra and/or bikini design, such as wiring, wire hooks, and the like.

The invention described herein comprises a design for a bikini top portion, a design for a bikini bottom portion, and a design for a combined bikini top and bottom. The overarching theme of the design of both the bikini top and the bikini bottom, as well as the combined top and bottom, is its modularity. The top and bottom may function as stand-alone items that can be mixed and matched for stylistic reasons, or to reduce garment waste, as noted in the Background.

A feature pertaining to the modularity of the invention described herein are the respective connector elements, as described in greater detail below and in the Detailed Description. The connector elements of the invention described herein provide a unifying element for the interchangeable and adjustable bikini attachment and closure system.

While the following summary references a combined bikini top and bottom system, it should be understood that the bikini top described herein may function as a stand-alone item, as may the bikini bottom described herein.

Briefly, the interchangeable and adjustable bikini attachment and closure system described herein comprises a bikini top portion, a bikini bottom portion, and connector elements or accessories that serve to close the bikini top and/or bottom and provide for size adjustability.

The bikini top comprises a bra frame, which in some respects is akin to a standard bikini top or bra, but is not limited in its design except by functional considerations (i.e., the bikini top or bra should provide appropriate covering and/or support according to their typical functions). The bra frame has a front support portion that includes the cups, as well as first and second wings, which are the portions of the bra that run from adjacent the cups towards the area of the bra that typically comprises the closure mechanism. The support portion, the cups, and the wings each have an inner and outer surface, and the wings themselves terminate at what are referred to as the first end portion and the second end portion, which generally correspond to the distal portion of the bra wings where a typical bra closure mechanism would be located.

At the terminus of each end portion is formed one or more loops in the bra material. The loop(s), which comprise a hole or tunnel through which a hook portion of the center back accessory described herein may be inserted, thus allowing the center back accessory to be connected to the bra frame, and serve as a closure mechanism for the bra frame in conjunction with the appropriate connector element. With multiple loops present at the terminus of the end portion, the hook portion of the center back accessory can be inserted into different loops on each side of the bra to allow for size adjustability.

The center back accessory described herein comprises at least one strap having a first end and a second end, with a loop formed at the first end of the strap to receive a shaft portion of a center back accessory connector element, and a loop at the second end of the strap to removeably receive a shaft portion of a separate center back accessory connector element. The straps connect the center back accessory elements to one another. The loop may be formed around the shaft of the center back accessory connector element, or it may be slid onto the center back accessory connector element until it is positioned about the shaft portion.

The center back accessory connector element also comprises a hook element or hook portion, which is located at an end area of the connector element, and is configured to removeably engage, or be inserted into, the loop or tunnel formed at the terminus of the end portions of the bra wings, thus connecting the center back accessory to the bra frame.

As further described in the Detailed Description, the bra frame may be fitted with sizing hooks on the outer surface of the terminus of the end portion of each wing (e.g., the outer surface of the tunnel portion), and the inner surface of the wing and/or end portion may be fitted with one or more guide loops that may be linearly arranged perpendicular to the long axis of the wing, as well as sizing loops configured to receive the sizing hooks. In this configuration, the size of the bra frame may be adjusted using the sizing hooks and sizing loops, and the hook elements on the center back accessory connector elements may be inserted through the one or more guide loops to connect the center back accessory to the bra frame, and serve as a closure mechanism for the bra frame or bikini top. Alternatively, sizing may be accomplished through the use of sliders on the straps that connect the center back accessory connector elements to vary the length of the straps. Alternatively, the straps may be comprised of one or more elastic materials that allow them to stretch to the appropriate size.

In addition to the straps between the center back accessory connector elements, the center back accessory straps may also comprise vertical straps. The vertical straps may be formed contiguously with the straps between the center back accessory connector elements, or they may be a separate piece of material attached to the straps between the center back accessory connector elements by known techniques. A distal end of each vertical strap contains a connector element (i.e., a vertical strap connector element) much like the center back accessory element in design, but perhaps sized or scaled differently. The vertical straps, of which two are preferred in design, but one or more than two are also conceivable, run generally perpendicular to the straps between the center back accessory connector elements and traverse a bikini wearer's shoulders so that the vertical strap connector elements may connect to small loops on the inner surface of the support portion of the bra frame. The vertical straps may also cross (i.e., the strap traversing the wearer's left shoulder may connect to a loop on the right side of the support portion of the bra frame, and vice-versa). In addition, the vertical straps may attach to a single loop on loops on the inner surface of the support portion of the bra frame located between the cups. Sizing of the vertical straps may be accomplished through the use of sliders on the vertical in order to vary the length of the straps. Alternatively, the vertical straps may be comprised of one or more elastic materials that allow them to stretch to the appropriate size.

The bikini bottom described herein comprises a front panel that may be, but is not required to be, generally triangular in shape, and a back panel that may be, but is not required to be, generally triangular in shape. Both the front panel and the back panel have first and second edges that generally correspond to what would be observed as a left or right edge.

At least one edge of both the front panel and the back panel comprise one or more bikini bottom reciprocal connecting portions, which may be referred to as the front panel bikini bottom reciprocal connecting portions, and the back panel bikini bottom reciprocal connecting portions. In an embodiment of the invention described herein in which only one edge of the front panel and one edge of the back panel have bikini bottom reciprocal connecting portions, then the bikini bottom reciprocal connecting portions must be on the same edge of the front and back panels (i.e., both of the left side or both on the right side). In another embodiment, there may be at least one bikini bottom reciprocal connecting portion on each edge of the front and back panels. In still another embodiment, there may be more than one bikini bottom reciprocal connecting portion on each edge of the front and back panels, and there is no particular requirement that the numbers be equal between the first edge or second edge.

Each bikini bottom reciprocal connecting portion, whether on the front panel or back panel, comprises at least one loop forming a hole at its terminal portion adapted to receive a hook element on a connector element from a side accessory that functions similarly to the center back accessory (and its connector elements) by serving to close an otherwise open edge (or edges) of the bikini bottom.

The bikini bottom further comprises a side accessory that comprises at least one strap, the strap comprising a first end portion and a second end portion. The first end portion comprises a loop that may be referred to as a first side accessory loop, and the second end portion comprises a loop that may be referred to as a second side accessory loop.

The bikini bottom further comprises a first side accessory connector element having a shaft portion and a hook element, much like the center back accessory connector element, and a second side accessory connector element also having a shaft portion and a hook element. The shaft portion of the first side accessory connector element is removeably engaged with the first side accessory loop on the first end portion of the at least one strap of the side accessory, and the shaft portion of the second side accessory connector element is removeably engaged with the second side accessory loop on the second end portion of the at least one strap of the side accessory. Removeable engagement may be accomplished by sewing the loop closed about the shaft portion, or sliding a pre-formed loop onto a side accessory connector element until it is position at or approximately at the shaft portion.

The side accessory connector elements also comprise a hook element that is configured to removeably engage with the loop or hole at or near the terminal portion of a bikini bottom reciprocal connecting portion and result in the attachment of the side accessory to the bikini bottom reciprocal connecting portion, and serve as a closure mechanism for one or more otherwise open edges of the bikini bottom front and back panels. Sizing of the side accessory strap(s) may be accomplished by sliders, or through use of one or more elastic materials to make the strap(s). With multiple loops present at bikini bottom reciprocal connecting portion, the hook elements of the side accessory connector elements can be inserted into different loops on each side of the bikini bottom to allow for size adjustability.

DETAILED DESCRIPTION OF THE INVENTION

Figure 1:
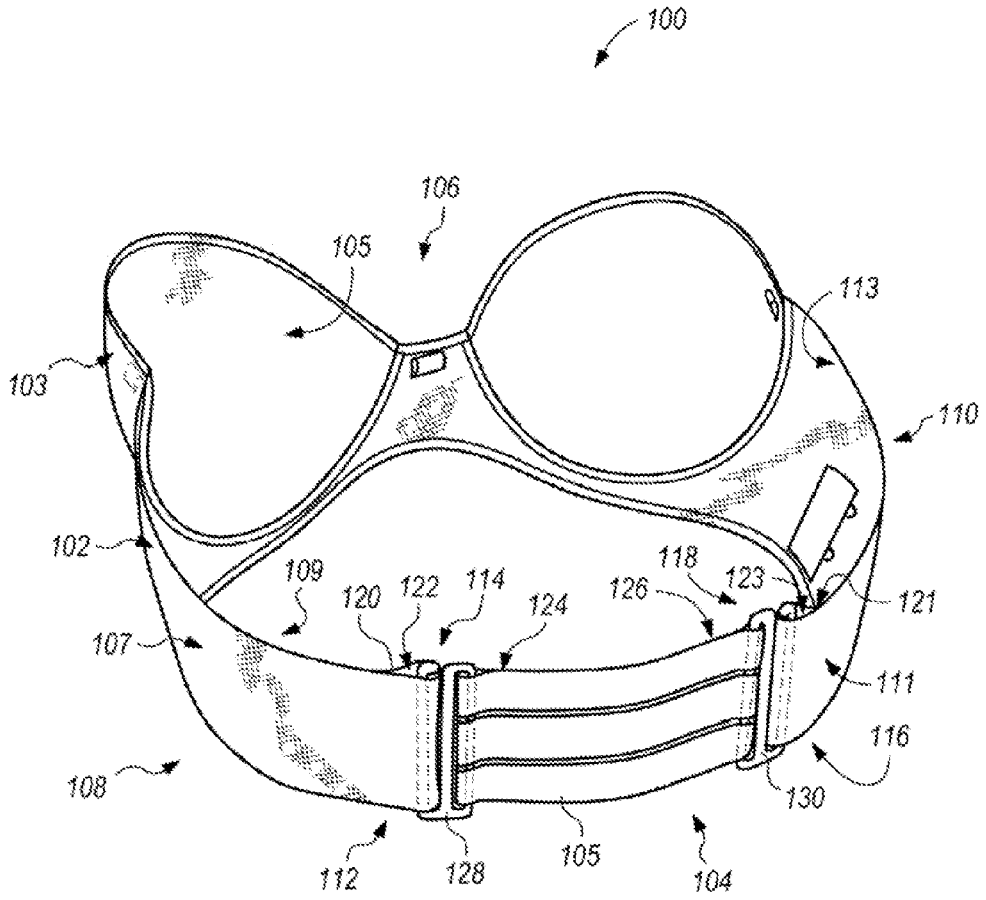
FIG. 1 is a rear perspective view of an embodiment of the interchangeable and adjustable bikini attachment and closure system for a bra or bikini upper shown in an attached configuration.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

It will be understood that, although the terms first, second, etc. may be used herein to describe various elements, these elements should not be limited by these terms. These terms are only used to distinguish one element from another.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Typically, materials used in manufactured apparel are fully wasted if unsalable, or must be deconstructed for re-use in new items. Most, or all, of the entire article of apparel is destroyed or sold at loss, resulting in higher rates of waste and/or lost profits. With the modular system of the present invention, manufactured apparel need not be fully wasted if unsalable, as the apparel becomes dynamic with the change of any or all straps or pieces that hold the article onto the part of the body to be covered. If a certain base piece or a closure piece is unsalable, only that separate piece will be destroyed or sold at a potential loss, resulting in lower rate of waste or lost profits.

The present invention creates numerous variations for a given item of apparel by using the attachment and closure system, which allows for interchangeable design elements to be added, subtracted, or exchanged entirely. Not to be mistaken for mere adornment, the modular article of apparel is rendered incomplete and un-wearable with one of the unlimited forms of detachable design elements. In other words, the interchangeable design elements of the present invention are not additive to an otherwise completed unit of apparel, but rather incorporates a base pieces, or platform, with a fastener and a closure piece holding the reciprocal fastener for attachment and/or detachment from the base piece.

As shown in FIG. 1, the interchangeable and adjustable bikini attachment and closure system 100 described herein comprises a bra frame 102 (which is understood to describe that portion of either a bra or bikini top), and a center back accessory 104 removeably attachable to bra frame 102. Bra frame 102 comprises a support portion 106 (which can also be referred to as a cradle, including a cradle having cups or coverings), which has an outer surface 103 and an inner surface 105. Bra frame 102 further comprises a left wing 108 having an outer surface 107 and an inner surface 109, and a right wing 110 having an outer surface 111 and an inner surface 113. Left wing 108 is generally adjacent to the left side of support portion 106, and right wing 110 is generally adjacent to the right side of support portion 106 and opposite left wing 108. Left wing 108 has a first end portion 112 comprising a first attachment portion 114 formed by the terminal part of end portion 112, and the right wing 110 has a second end portion 116 comprising a second attachment portion 118 formed by the terminal part of end portion 116. First attachment portion 114 comprises at least one loop 120 that forms a hole 122 that is disposed generally orthogonally to left wing 108. Second attachment portion 118 also comprises at least one loop 121 that forms a hole 123 that is disposed generally orthogonally to right wing 110. Loop 120 may be formed by end portion 112 of the left wing 108 being formed back onto itself and sewn or otherwise attached onto itself. Loop 121 may be similarly formed relative to end portion 116 of the right wing 110. Loop 120 may be referred to as the "first end portion loop," and loop 121 may be referred to as the "second end portion loop."

Figure 9:
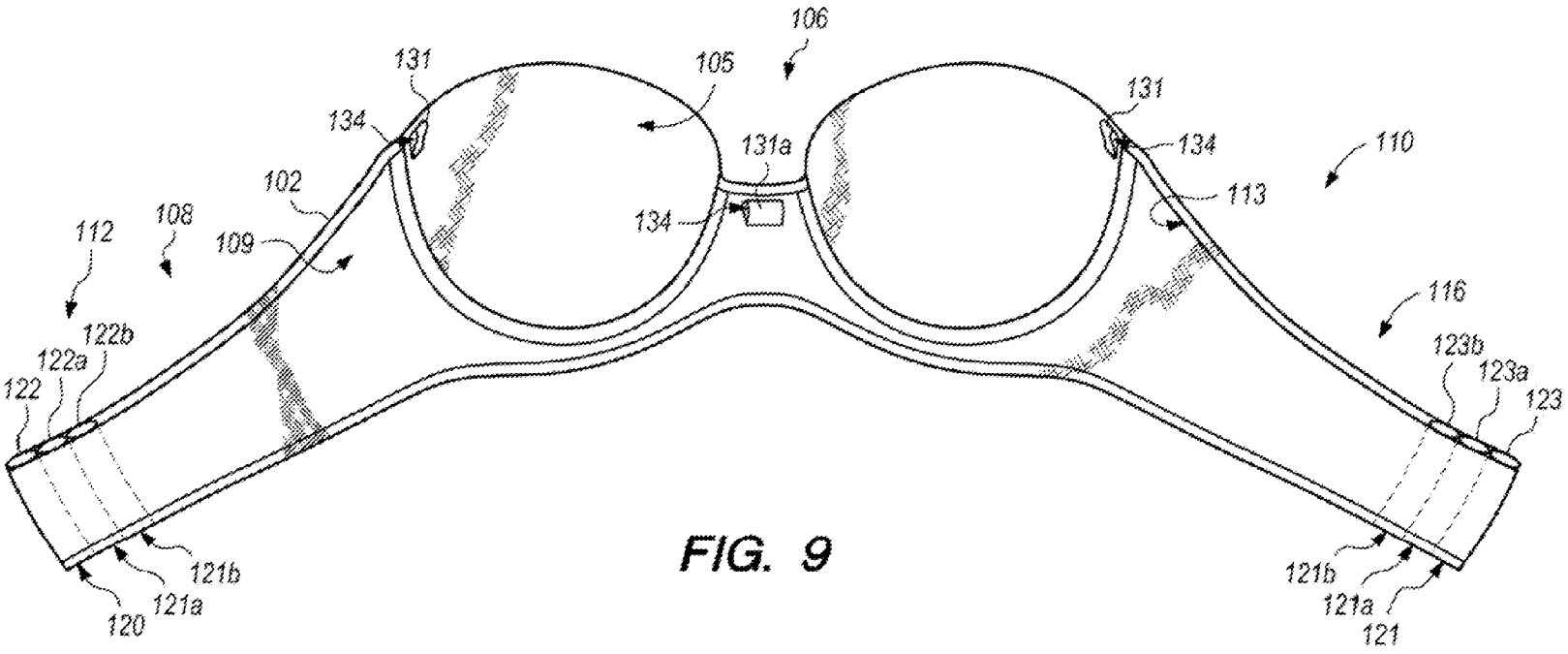
FIG. 9 is a rear view of another embodiment of the bra frame of the interchangeable and adjustable bikini attachment and closure system.

There may be more than one first end portion loop (e.g., loops 120*a*, 120*b* as shown in FIG. 9) formed at the end portion 112 of the left wing 108, thus forming holes 122*a*, 122*b* (as shown in FIG. 9); and there may be more than one second end portion loop (e.g., loops 121*a*, 121*b* as shown in FIG. 9) formed at the end portion 116 of the right wing 110, thus forming holes 123*a*, 123*b* (as shown in FIG. 9), the foregoing arrangement allowing for sizing adjustment. Where multiple loops are present on an end portion of one of the wings, the material at the end portion of the wing may be folded back onto itself and sewn to form multiple loops.

It is understood that bra frame 102 is not limited to any particular shape or configuration other than as dictated by the function of the bra frame.

Figure 2:
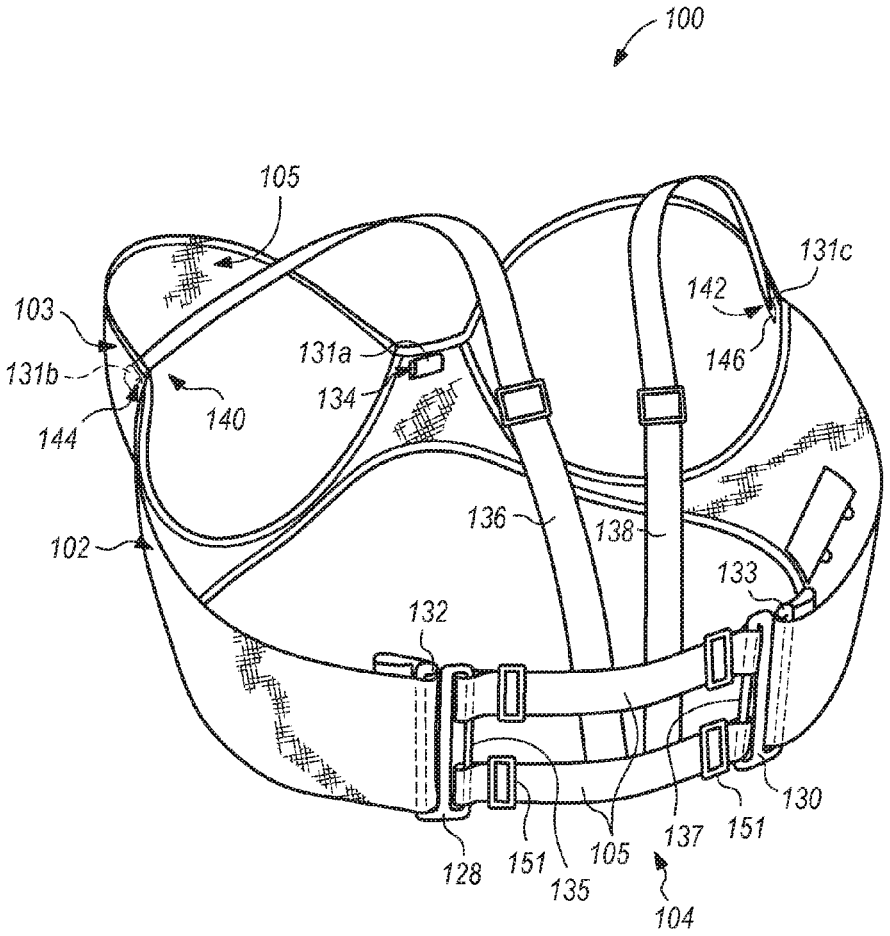
FIGS. 2, 2A, and 2B are rear perspective views of a second embodiment of the interchangeable and adjustable bikini attachment and closure system for a bra or bikini shown in an attached configuration and showing different options for attaching the vertical straps to the support portion.
Figure 2A:
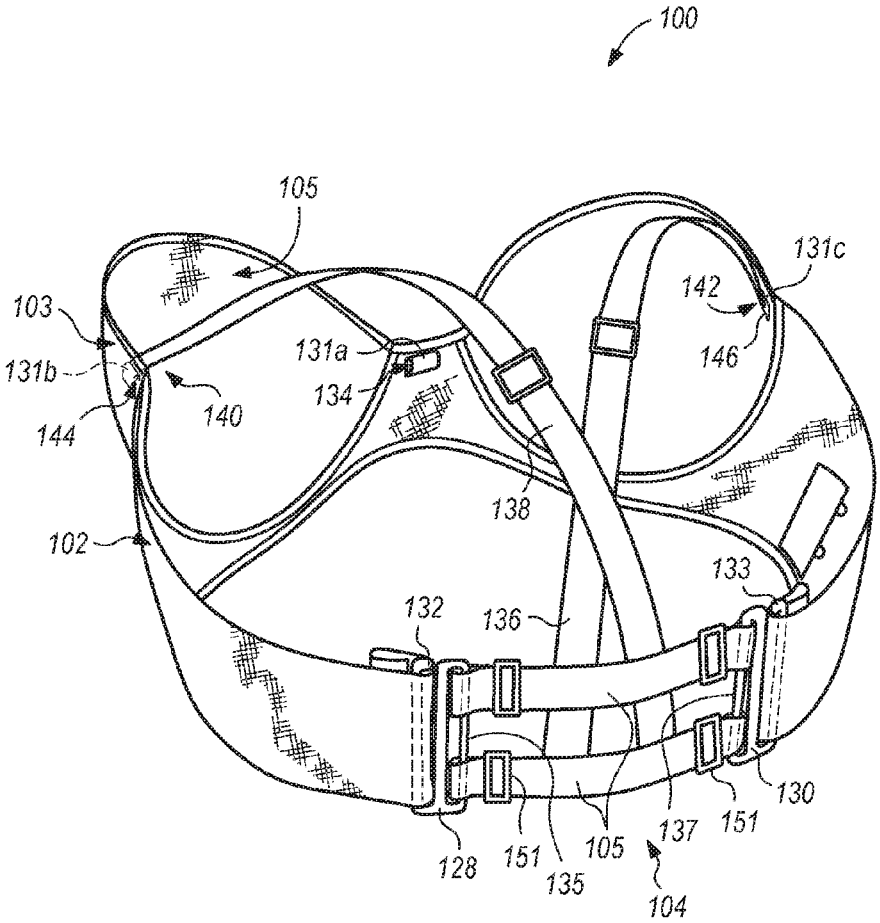

The center back accessory 104 is capable of being removeably connected to bra frame 102, as shown in e.g., FIGS. 1 and 2, and may have different lengths and/or adjustable sliders 151. The design of center back accessory 104 is not limited to those shown in the drawings (i.e, having two or three rectangular, generally horizontally articulating straps 105 as in e.g., FIGS. 1, 5, 6, and 7) and/or several vertically articulating straps 136, 138 as in e.g., FIG. 2), but can be substantially varied in shape and/or orientation to provide many different looks, while remaining consistent with the spirit of the invention described herein.

Figure 4B:
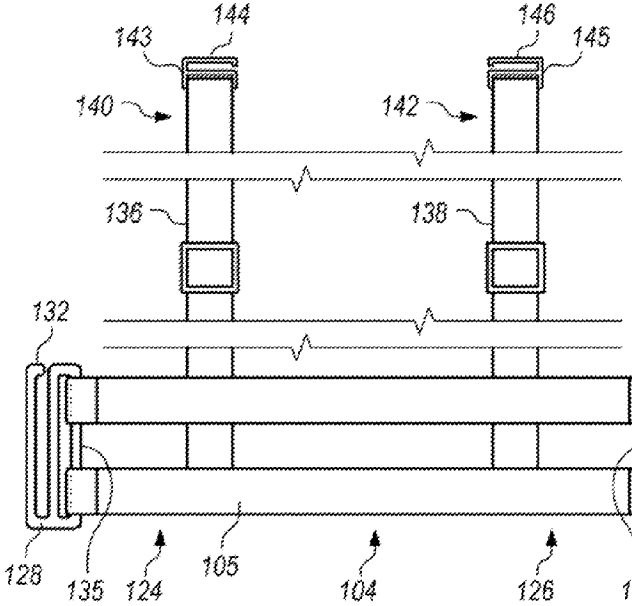
FIG. 4B is a front view of another embodiment of the embodiment of a center back accessory of the interchangeable and adjustable bikini attachment and closure system.
Figure 4A:
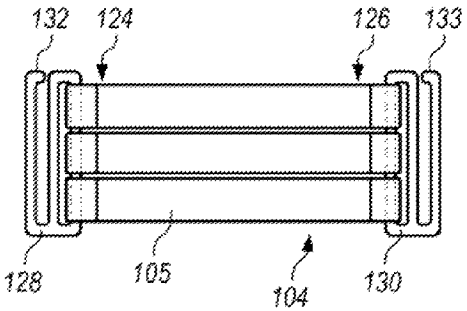
FIG. 4A is a front view of an embodiment of the center back accessory of the interchangeable and adjustable bikini attachment and closure system.
Figure 5:
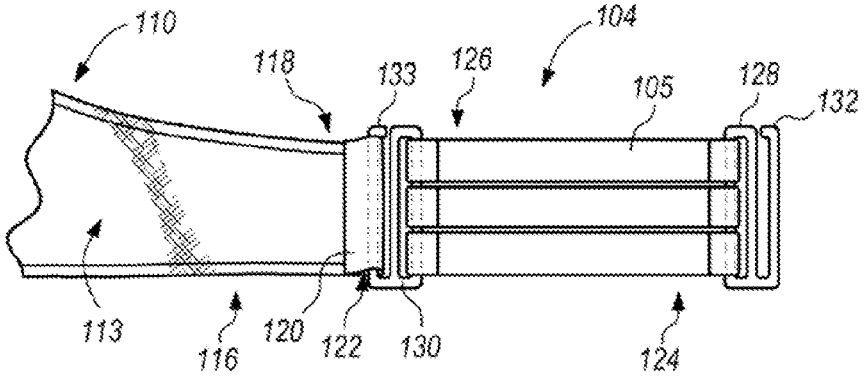
FIG. 5 is a partial view of an embodiment of the center back accessory attached to one end of the bra frame of the interchangeable and adjustable bikini attachment and closure system.

As shown in FIGS. 1 and 4A, center back accessory 104 comprises a first center back accessory end portion 124 and a second center back accessory end portion 126. Center back accessory 104 further comprises a first reciprocal connector element 128 that is adjacent to, and affixed to or connected with, the first center back accessory end portion 124, and a second reciprocal connector element 130 adjacent to, and affixed to or connected with, the second center back accessory end portion 126. First and second reciprocal connector elements 128, 130 each comprise at least one shaft 135, 137.

First and second center back accessory end portions 124, 126 each comprise at least one loop formed by one or more straps 105 being folded back and sewn or otherwise attached onto itself to form at least one loop. In making center back accessory 104, the loop formed at or near both first and second center back accessory end portions 124, 126 is fitted around shaft 135, 137, each shaft being part of first reciprocal connector element 128 and second reciprocal connector element 130, respectively. Alternatively, the loop can be preformed and slid onto an end of a reciprocal connector element for ultimate placement along the shaft thereof. This construction enables one or more straps 105 to connect first and second reciprocal connector elements 128, 130 to each other, and also results in a functionally unitary construction for center back accessory 104. The loops formed at the end portions of the straps of the center back accessory may be referred to as "first center back accessory loop" and "second center back accessory loop."

As shown in e.g., FIGS. 1, 4A, 4B, 5, 6, and 7, first reciprocal connector element 128 further comprises first hook element 132, and second reciprocal connector element 130 further comprises second hook element 133. Center back accessory 104 is removeably attachable to bra frame 102 through insertion of first hook element 132 into hole 122 formed by loop 120 of the first attachment portion 114 on bra frame 102, and insertion of second hook element 133 into hole 123 formed by loop 121 of the second attachment portion 118 on bra frame 102.

In the embodiment shown in FIG. 9, which is designed to facilitate size adjustability, center back accessory 104 is removeably attachable to bra frame 102 through insertion of first hook element 132 into one of holes 122, 122*a*, or 122*b* formed by loops 120, 120*a*, and 120*b* of the first attachment portion 114 on bra frame 102, respectively; and, insertion of second hook element 133 into one of holes 123, 123*a*, or 123*b* formed by loops 121, 121*a*, and 121*b* of the second attachment portion 118 on bra frame 102, respectively.

Consequently, the complete article of body covering or protection may be variably altered and configured by separating first attachment portion 114 and second attachment portion 118 from the first and second reciprocal connector elements 128 and 130 and joining the same bra frame 102 with different center back accessories, or joining the same center back accessory 104 with different bra frames.

In alternative embodiments, first attachment portion 114 (with the corresponding loop and hole) on bra frame 102 may comprise a first female fastener and the first reciprocal connector element 128 (including hook element 132) on the center back accessory 104 may comprise be a first male fastener that removeably mates with the first female fastener. The same configurations are applicable to second attachment portion 118 (with the corresponding loop and hole) and second reciprocal connector element 130, thus as a second female fastener and a second male fastener removably mated. Alternatively, the male and female portions with respect to the attachment configuration referenced immediately above may be reversed with a male portion associated with bra frame 102 and a female portion associated with center back accessory 104.

Examples of such alternative attachment configurations may also include a snap fastener with male and female portions, a button and hole configuration, a buckle configuration, hook and loop fasteners (i.e., Velcro®), a zipper configuration, or other fastening mechanisms known in the art.

Figure 2B:
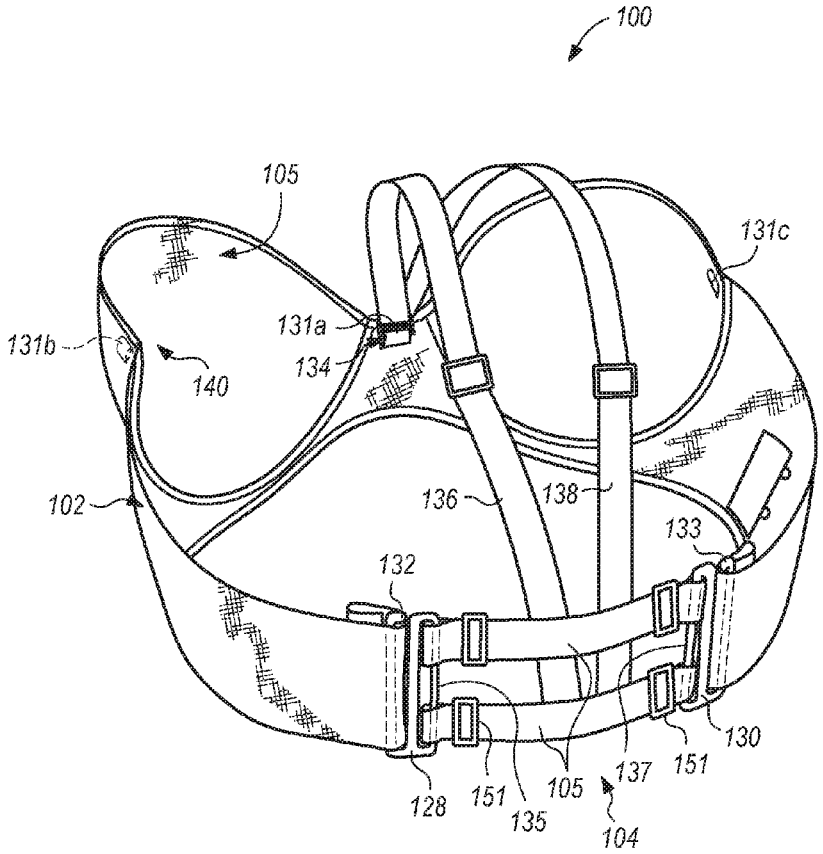
Figure 3:
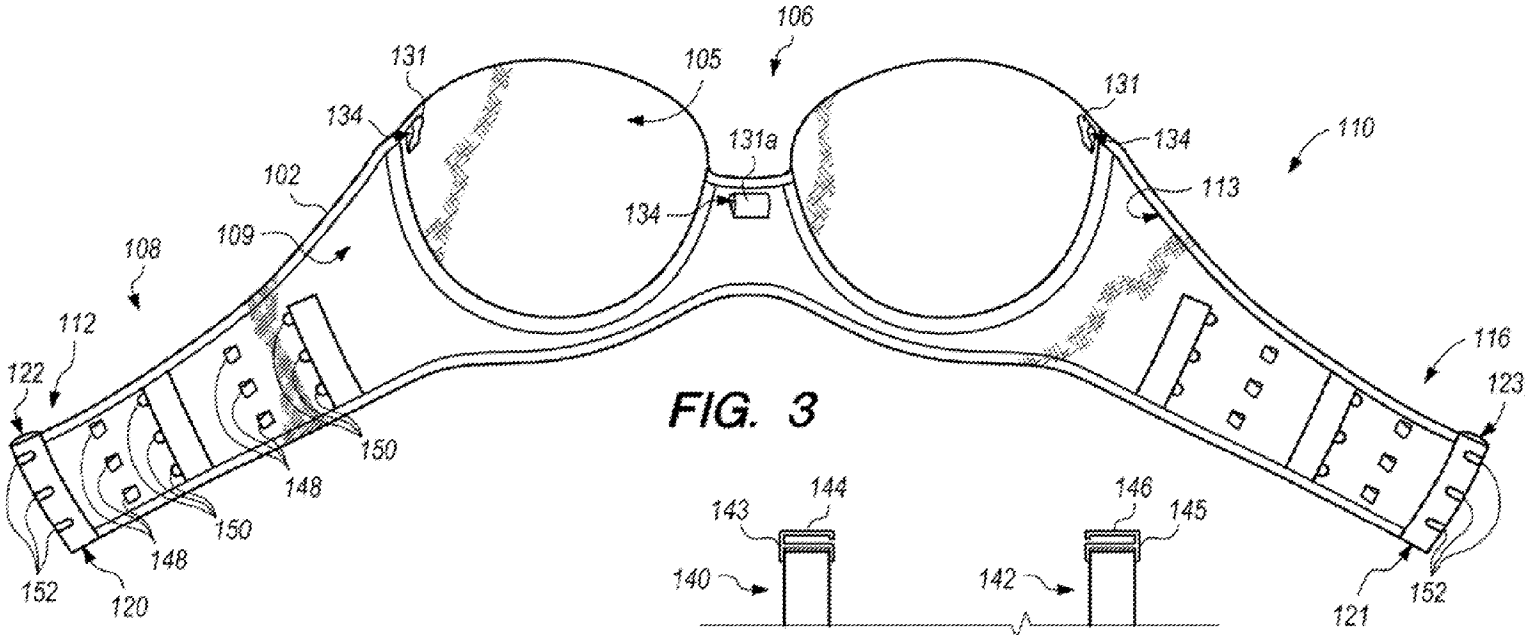
FIG. 3 is a rear view of an embodiment of the bra frame of the interchangeable and adjustable bikini attachment and closure system.

Another embodiment of the interchangeable and adjustable bikini attachment and closure system 100, shown in FIG. 2, may have at least one minor loop 131*a-c* (as also shown in FIG. 3). The at least one minor loop 131*a-c* may be attached on inner surface 105 of bra frame 102 (or to the corresponding unnumbered inner surface of the opposite cup, or to the inner surfaces of both cups as shown in FIGS. 2B and 2C). Minor loop 131*a* may also be attached to the inner surface of support portion 106 of bra frame 102 between the cups (often referred to as the center front gore). Minor loop 131*b, c* or 131*a*, in any of the aforementioned locations, or all of them, is formed by a separate piece of fabric or other suitable materials attached to the inner surfaces of the cups, or to the inner surface of support portion 106, of bra frame 102, wherein such separate piece of fabric or other suitable material is folded to form a hole 134. Minor loops 131*b, c* may be referred to as "inner surface minor loops." Minor loop 131*a* may be referred to as "center front minor loop."

Center back accessory 104 may also comprise a first vertical strap 136 and a second vertical strap 138 attached to the center back accessory 104 via means known in the art. First vertical strap 136 has a first vertical strap end portion 140, and the second vertical strap 138 has a second vertical strap end portion 142. As shown in FIG. 4B, attached to first vertical strap end portion 140 is a first vertical strap reciprocal connector element 143, and attached to second vertical strap end portion 142 is a second vertical strap reciprocal connector element 145. First vertical strap reciprocal connector element 143 comprises a shaft portion (not shown) around which first vertical strap end portion 140 is sewn or otherwise affixed. Second vertical strap reciprocal connector element 145 also comprises a shaft portion (not shown) around which second vertical strap end portion 142 is sewn or otherwise affixed. First vertical strap reciprocal connector element 143 further comprises hook element 144, and second vertical strap reciprocal connector element 145 further comprises hook element 146. Hook elements 144 and 146 are reversibly connectable to the two minor loops 131*b, c* on the inner surfaces 105 of bra frame 102 (e.g., on the inner surfaces of the cups), or both may be simultaneously reversibly attached to the inner surface of support portion 106 of bra frame 102 at minor loop 131*a*. Hook element 144 may be referred to as "third hook element." Hook element 146 may be referred to as "fourth hook element."

Adjustable sizing of the vertical straps may be accomplished via varying the lengths of the straps, or by affixing sliders to the straps that allow for length adjustment by a user.

In one embodiment of the interchangeable and adjustable bikini attachment and closure system 100 shown in FIG. 3, to adjust the length (or girth), bra frame 102 may have guide loops 148, sizing loops 150, and sizing hooks 152. Sizing hooks 152, preferably formed from thin bent-wire hooks, are attached at or generally adjacent to end portion 112 of inner surface 109 of left wing 108 of bra frame 102, and/or at or generally adjacent to end portion 116 of inner surface 113 of right wing 110 of bra frame 102. Each of the guide loops 148 is a separate piece of material folded to form a loop and is attached on inner surface 109 of left wing 108, and/or on inner surface 113 of right wing 110, with the attachment loci for the guide loops 148 being at spaced intervals corresponding to the desired measure of adjustment needed, and may be, but are not required to be, attached equidistant between sizing hooks 152 and one or more sets of sizing loops 150. Each sizing loop 150, preferably made of thin wire bent to form a U-shape, is attached on inner surface 109 of left wing 108, and/or on inner surface 113 of right wing 110. Sizing loops 150 may be attached at intervals corresponding to the desired measure of adjustment. Measuring a length from where first reciprocal connector element 128 on center back accessory 104 attaches to bra frame 102 to where second reciprocal connector element 130 on center back accessory 104 attaches to bra frame 102, the length may be adjusted using sizing loops 150 and sizing hooks 152.

Figure 7:
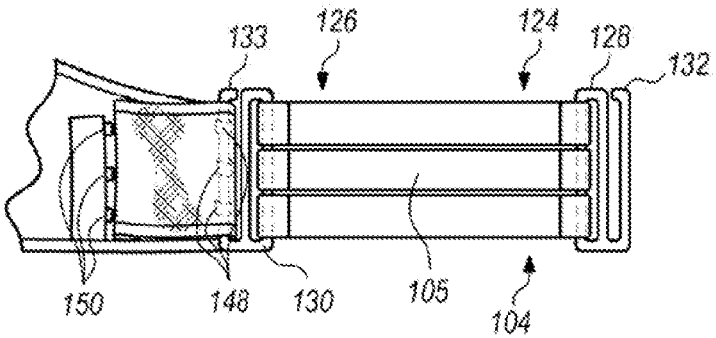
FIG. 7 is a partial view of yet another embodiment of the center back accessory attached to one end of the bra frame of the interchangeable and adjustable bikini attachment and closure system.

As shown in FIG. 7, and in use, first reciprocal connector element 128 (FIG. 4A) and second reciprocal connector element 130 (FIG. 4A) may removeably attach to guide loops 148 formed by left wing 108 and right wing 110 via hooks 132, 133 being inserted into the corresponding guide loops 148 on the inner surfaces 109, 113 of left and right wings 108, 110 of bra frame 102.

Figure 6:
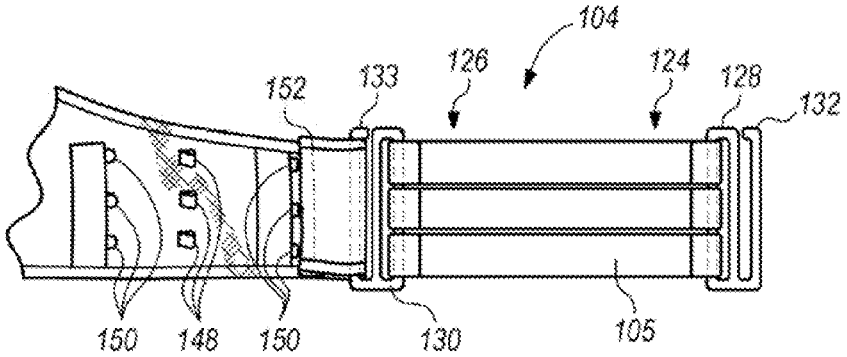
FIG. 6 is a partial view of another embodiment of the center back accessory attached to one end of the bra frame of the interchangeable and adjustable bikini attachment and closure system.

Alternatively, first reciprocal connector element 128 (FIG. 4A) and second reciprocal connector element 130 (FIG. 4A) may be removeably attached to the left wing 108 and the right wing 110, as shown in FIG. 6, wherein hooks 132 are disposed generally adjacent to inner surface 109 of left wing 109 of bra frame 102, and/or inner surface 113 of right wing 110 of bra frame 102, respectively. Then, sizing hooks 152 on left wing 108 and right wing 110 are removeably attached to sizing loops 150 on left wing 108 and/or on right wing 110, respectively, such that when the sizing hooks are engaged with the sizing loops, the reciprocal connector elements are securely, but removably connected to bra frame 102, thus allowing for a fully-formed and functional bikini top or bra.

In use, as shown in FIG. 6, right wing 110, for example, may fold over, after a hook 133 on second reciprocal connector element 130 slides through and removeably attaches to a loop formed by the sizing hooks 152 removeably attaching to the sizing loops 150. In another configuration, as shown in FIG. 7, right wing 110, for example, may fold over, after hook 133 on second reciprocal connector element 130 slides through guide loops 148 of their choosing, such that the sizing hooks 152 on right wing 110 may hook onto the sizing loops 150 on right wing 110, removeably housing the second reciprocal connector element 130. Depending on the length required by a user, the second reciprocal connector element 130 may slide into other guide loops 148, closer or farther away from the support portion 106. An alternative embodiment for adjustable sizing may be accomplished by having only a single attachment point for the center back accessory 104 on the left and right wings of the bra frame, wherein the straps of the center back accessory are adjustable via a sliding sizing mechanism.

In each of the aforementioned embodiments, the first attachment portion 114 and second attachment portion 118, as well as the first reciprocal connector element 128 and second reciprocal connector element 130, may comprise, but are not limited to, other attachment or connection configurations such as snaps fasteners, buckles, buttons, or hook and loop fasteners (e.g., Velcro®). Bra frame 102 may be made of materials such as, but not limited to, for example, cotton, Polyester, Lycra, Nylon, Rayon, or blends of the same, etc. Center back accessory 104 may be made of similar materials and/or other elastic materials alone or in combination, or non-elastic materials, if desired. First attachment portion 114 and second attachment portion 118 may be made of, by way of examples without limitation, metals, metal alloys, plastics, polymers, combinations thereof, or any other suitable material(s).

Additional configurations of the reciprocal connector elements are also contemplated wherein the reciprocal connector elements may be also located on or affixed at other locations on the bra frame 102 or the center back accessory 104 than those described herein or shown in the Figures appended hereto. A separate connector accessory is also contemplated. Stand-alone straps are examples of separate accessories that may be used for shoulder support of the bra frame, and may also be removeably attached on the bra frame 102 or center back accessory 104, such that the first reciprocal connector element is on the bra frame 102 or center back accessory 104, and second reciprocal connector element is affixed or located on the separate accessory, or vice versa. Therefore, the interchangeable aspect of the interchangeable and adjustable bikini attachment and closure system 100 is not exclusive to the center back accessory 104 and bra frame 102.

Figure 8:
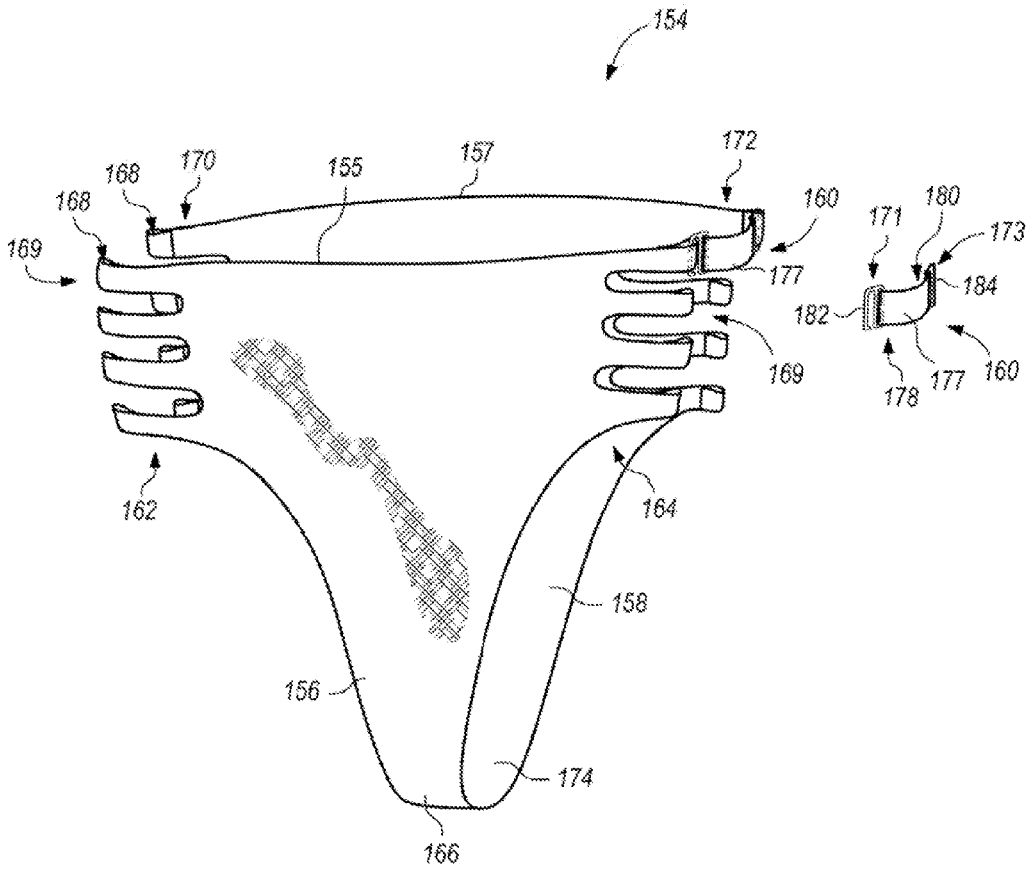
FIG. 8 is a front perspective view of an embodiment of the bikini bottom, including the side accessory, of the interchangeable and adjustable bikini attachment and closure system.

As shown in FIG. 8, the interchangeable and adjustable bikini attachments and closure system 100 may also further comprise a bikini bottom 154 comprising a generally triangular-shaped front panel 156, a generally triangular-shaped back panel 158, and at least one side accessory 160. It is contemplated that bikini bottom 154 may be adapted to receive one or more side accessories 160 on each side. It is also contemplated that one side of bikini bottom 154 may have a substantially "unitary" construction whereas the other side may require side accessory 160 to connect the front of bikini bottom 154 to the back of bikini bottom 154. It is further contemplated that the bikini bottom can be of any shape appropriate relative to its function, and is expressly not limited to a generally triangular shape.

Front panel 156 has a left edge 162, a right edge 164, a bottom portion 166, and a top edge 155. Back panel 158 has a left edge 170, a right edge 172, a bottom portion 174, and a top edge 157. Front panel 156 is generally adjacent to the back panel 158 at their respective bottom portions 166, 174.

The design of bikini bottom 154 may be such that the upper portions of front panel 156 and back panel 158 may not be of "unitary" construction (i.e., the respective upper portions of the front and back panels may not be attached to one another), such that left edges 162, 170 and right edges 164, 172 comprise at least one bikini bottom reciprocal connecting portion 169 on each side, each of the latter of which further comprises at least one loop 168. Although, as noted above, it is contemplated that this connection configuration may be present on only the left or right side of bikini bottom 154. Loops 168 on the front and back panels may be referred to as "front panel loop" and "back panel loop," respectively. It is contemplated that the invention described herein may have one or more front panel loops, and one or more back panel loops, to allow for sizing adjustability.

Figure 10:
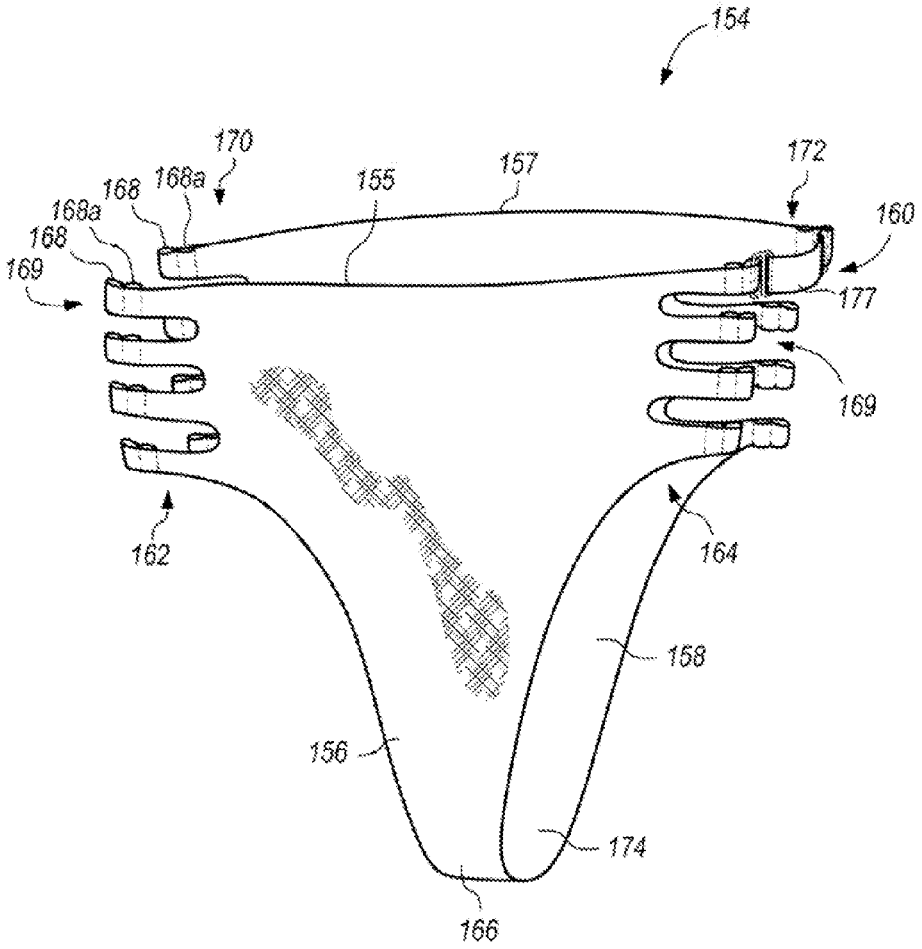
FIG. 10 is a front perspective view of another embodiment of the bikini bottom, including the side accessory, of the interchangeable and adjustable bikini attachment and closure system.

More specifically, each bikini bottom reciprocal connecting portion 169 may comprise multiple loops 168, as shown in FIG. 10 and described more fully below.

As shown in FIG. 8, side accessory 160 comprises a first end portion 178 and a second end portion 180. Side accessory 160 further comprises a side accessory reciprocal connector element 171 that is adjacent to, and affixed to or connected with, first end portion 178, and a second side accessory reciprocal connector element 173 that is adjacent to, and affixed to or connected with, second end portion 180. First and second side accessory reciprocal connector elements each comprise at least one shaft.

First and second end portions 178, 180 of side accessory 160 each comprise at least one loop formed by one or more straps 177 being folded back and sewn or otherwise attached onto itself to form at least one loop. In making side accessory 160, the loop formed at or near both end portions 178, 180 is fitted around the shaft, each shaft being part of first and second side accessory reciprocal connector elements 171, 173, respectively. Alternatively, the loop can be preformed and slid onto an end of a side accessory reciprocal connector element for ultimate placement along the shaft thereof. This construction enables one or more straps 177 to connect first and second side accessory reciprocal connector elements 171, 173 to each other, and results in a functionally unitary construction for side accessory 160. The loops at the end portions of straps 177 may be referred to as "first side accessory loop" and "second side accessory loop."

First side accessory reciprocal connector element 171 of side accessory 160 comprises a first side accessory hook element 182 that is generally adjacent to first end portion 178 of side accessory 160. Second side accessory reciprocal connector element 173 of side accessory 160 comprises a second side accessory hook element 184 that is generally adjacent to second end portion 180 of side accessory 160. For example, for one of the side accessories 160, the first side accessory hook element 182 may be removeably attached to a loop 168 on left edge 162 of front panel 156, and second side accessory hook element 184 may be removeably attached to a loop 168 on left edge 170 of back panel 158.

In the embodiment shown in FIG. 10, and as an example, where multiple loops 168 are present on a given bikini bottom reciprocal connecting portion 169, one side accessory hook element (e.g., 182) may be removably attached to one of several loops 168 on left edge 162 of front panel 156, and the same may be true for the other side accessory hook element (e.g., 184) relative to left edge 170 of back panel 158, thus allowing for size adjustability.

Thus, side accessory reciprocal connector elements 171, 173 are removeably attachable to a loop 168 (i.e., a front panel loop) on a bikini bottom reciprocal connecting portion 169, preferably with first end portion 178 attaching to a loop 168 on a bikini bottom reciprocal connecting portion 169 on front panel 156 via first side accessory hook element 182, and second end portion 180 attached to a loop (i.e., a back panel loop) on a bikini bottom reciprocal connecting portion 169 on back panel 158 via second side accessory hook element 184. When the necessary number of side accessories 160 have been applied to connect front panel 156 to back panel 158, a functional bikini bottom 154 is formed.

Figure 11:
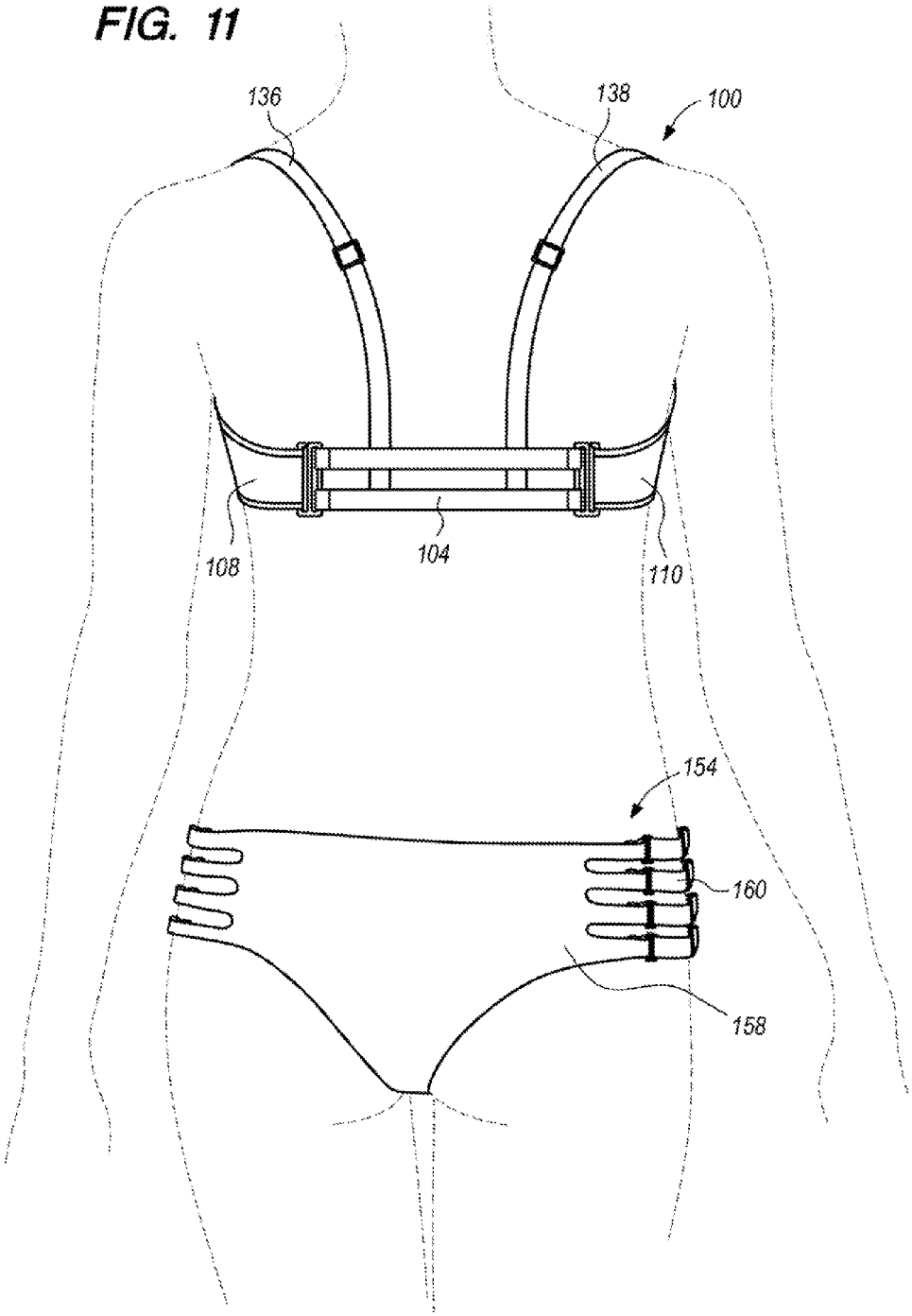
FIG. 11 is a rear perspective view of an embodiment of the invention in use, showing the bra frame shown in FIG. 9 with the center back accessory shown in FIG. 4B, and the bottom shown in FIG. 10 as worn by a user.

FIG. 11 shows the interchangeable and adjustable bikini attachment and closure system 100 described herein in use and operation. The system 100 is depicted on a mannequin-like wearer (shown in broken lines) of the bikini system 100 described herein. The bra portion of the system comprises wings 108, 110, which are connected and closed about a user's back via center back accessory 104. Center back accessory 104 comprises vertically articulating straps 136, 138 that traverse the user's shoulders and engage with one more minor loops on the front portion of bra 102. FIG. 11 also depicts the mannequin-like wearer wearing bikini bottom 154 wherein the open sides of bikini bottom 154 are connected and closed by one or more side accessories 160. Thus, the interchangeable and adjustable bikini attachment and closure system 100 is depicted in use and operation.

In a preferred embodiment, at least a portion of each of left edge 162 and right edge 164 folds back and is sewn or otherwise attached onto itself to form at least one loop 168, each loop 168 disposed generally orthogonally to top edge 155. Similarly, at least a portion of each of left edge 170 and right edge 172 folds back and is sewn or otherwise attached onto itself to form at least one loop 168, each loop 168 disposed generally orthogonally to top edge 157. Where multiple loops are present on a single bikini bottom reciprocal connecting portion 169, the material at the edge may be folded back onto itself and sewn to form multiple loops.

It is contemplated that the interchangeable and adjustable bikini attachment and closure system 100 may be configured to allow center back accessory 104 to be removeably attachable to the bra frame 102 at other locations than those shown herein. Furthermore, the bikini bottom 154 to the bra frame 102 may be connected by another accessory. Or, as shown in FIG. 3, center back accessory 104 may be connected to a center area of support portion 106 of bra frame 102.

The method of making an interchangeable and adjustable bikini attachment and closure system 100 comprises permanently forming or attaching, which includes, but is not limited to, fastening, sewing, gluing, welding, riveting, stapling, or joining the first and second attachment portions 114, 118 to bra frame 102, and the first and second reciprocal connector elements 128, 130 to center back accessory 104. More specifically and preferably, the method of making an interchangeable and adjustable bikini attachment and closure system comprises permanently forming or attaching, which includes, but is not limited to, sewing, gluing, welding, riveting, stapling, or joining at least one left loop 120 and at least one right loop 121 to bra frame 102, wherein left and right loops 120, 121 form at least one hole each 122, 123, each disposed generally orthogonally to left and right wings 108, 110, and formed by having respective end portions 112, 116 of left and right wings 108, 110 fold back onto themselves and sewn or otherwise attached onto themselves. Where multiple loops are present on an end portion of one of the wings, the material at the end portion of the wing may be folded back onto itself and sewn to form multiple loops.

Also, the method comprises permanently forming or attaching, which includes, but is not limited to, fastening, sewing, gluing, welding, riveting, stapling, or joining first hook element 132 and second hook element 133 to center back accessory 104, such that first hook element 132 may pass through left loop 120 of bra frame 102, and second hook element 133 may pass through right loop 121 of bra frame 102. Once completed, first and second hook elements 132, 133 are removeably attachable to left and right loops 120, 121, respectively, thereby allowing center back accessory 104 to be removeably attached to bra frame 102.

The method of making the interchangeable and adjustable bikini attachment and closure system may further comprise permanently forming, which includes, but is not limited to, fastening, sewing, gluing, welding, riveting, stapling, or joining a bikini bottom, wherein left and right edges 162, 164, 170, 172 fold back and are sewn or otherwise attached onto themselves so as to form at least one loop 168 on each front, back, and/or side. Front panel 156 may be attached to back panel 158 at their respective bottom portions 166, 174. Where multiple loops are present on a single bikini bottom reciprocal connecting portion 169, the material at the edge may be folded back onto itself and sewn to form multiple loops.

The method of making the interchangeable and adjustable bikini attachment and closure system 100 may further comprise permanently forming, which includes, but is not limited to, fastening, sewing, gluing, welding, riveting, stapling, or joining one or more side accessories 160, such that first side accessory hook element 182 is generally adjacent to first end portion 178 of side accessory 160, and second side accessory hook element 184 is generally adjacent to second end portion 180 of side accessory 160. First side accessory hook element 182 may pass through corresponding loop 168 on front panel 156 of bikini bottom 154, and second side accessory hook element 184 may pass through corresponding loop 168 on back panel 158 of bikini bottom 154, allowing side accessory 160 to be connected on one or both sides of bikini bottom 154, depending on whether neither or one side of bikini bottom 154 are of "unitary" construction. The end result being a fully-functional bikini bottom.

The method of making an interchangeable and adjustable bikini attachment and closure system may further comprise permanently forming or attaching, which includes, but is not limited to, fastening, sewing, gluing, welding, or joining minor loop 131*a* to the inner surface of support portion 106 of bra frame 102, wherein minor loop 131*a* is formed by having a separate piece of material attached to support portion 106 and folded or otherwise formed to create a loop with a hole 134.

The method of making the interchangeable and adjustable bikini attachments and closure system 100 may further comprise permanently forming or attaching, which includes, but is not limited to, fastening, sewing, gluing, welding, riveting, stapling, or joining vertical straps 136, 138 onto center back accessory 104, wherein hook elements 144, 146 on first and second vertical straps 136, 138 are each attached generally adjacent to the end portion of one of vertical straps 136, 138, such that hook element 144 and hook element 146 may be removeably attached to the corresponding minor loops 131*b, c* on support portion 106 of bra frame 102, or both hook elements may be removeably attached to minor loop 131*a*.

The method of making the interchangeable and adjustable bikini attachments and closure system 100 may further comprise permanently forming or attaching, which includes, but is not limited to, fastening, sewing, gluing, welding, or joining guide loops 148, sizing loops 150, and sizing hooks 152 on bra frame 102 to provide for size adjustments for the wearer. Sizing hooks 152 are attached generally adjacent end portions 112, 116 of inner surface of left and right wings 108, 110 of bra frame 102. Guide loops 148 are attached on the inner surface of left and right wings 108, 110 at intervals corresponding to a desired measure of adjustment. Each sizing loop 150 is also attached on the inner surface of left and right wings 108, 110 at intervals between each guide loop 148 and sizing hooks 152. Thus, first and second reciprocal connector elements 128, 130 via hook elements 132, 133 are removeably connectable to guide loops 148 of left and right wings 108, 110, respectively, as shown in FIG. 7. Sizing loops 150 on each of the left and right wings 108, 110 are also removeably connectable to sizing hooks 152 on the same left or right wings 108, 110, respectively, effectively folding the left and right wings 108, 110 when the sizing hooks are so engaged with the sizing loops, and simultaneously sizing the garment as desired and covering the attachment of the reciprocal connector elements to the guide loops.

The foregoing description of presently preferred embodiments of the invention has been presented for the purposes of illustration and description only. It is not intended to be exhaustive or to limit the invention to the precise form(s) disclosed. Many modifications and variations are possible in light of the above teachings while remaining consistent with the spirit of the invention. It is intended that the scope of the invention not be limited by this detailed description, but by the claims and the equivalents to the claims appended hereto.

What is claimed is:

1. An interchangeable and adjustable bikini top comprising:

a bra frame;

the bra frame comprising a support portion and first and second wings;

the first and second wings each comprising an inner surface and an outer surface;

the first wing further comprising a first end portion, and the second wing further comprising a second end portion;

the first end portion comprising at least one first loop, and the second end portion comprising at least one second loop;

a center back accessory, the center back accessory comprising:

at least one strap having a first end and a second end, the at least one strap comprising a first center back accessory loop adjacent the first end of the at least one strap, and a second center back accessory loop adjacent the second end of the at least one strap the at least one strap defining a length;

a first connector element comprising a shaft portion and a hook element, and a second connector element comprising a shaft portion and a hook element;

the shaft portion of the first connector element engaged with the first center back accessory loop adjacent the first end of the at least one strap, and the shaft portion of the second connector element engaged with the second center back accessory loop adjacent the second end of the at least one strap;

wherein the hook element on the first connector element is removeably engaged with one of the at least one first loops of the first end portion on the first wing of the bra frame, and the hook element on the second connector element is removeably engaged with one of the at least one second loops of the second end portion on the second wing of the bra frame to completely separate the center back accessory from the bra frame; wherein the support portion comprises an outer surface and an inner surface;

a first minor loop formed from a first separate piece of material and attached completely on the inner surface of the left side of the support portion, and a second minor loop formed from a second separate piece of material and attached completely on the inner surface of the right side of the support portion;

the center back accessory having a first vertical strap on the left side and a second vertical strap on the right side;

the first vertical strap comprising a first vertical strap end portion, the first vertical strap end portion being connected to a third hook element;

the second vertical strap comprising a second vertical strap end portion, the second vertical strap end portion being connected to a fourth hook element;

the third hook element is reversibly connected to the first minor loop; and, the fourth hook element is reversibly connected to the second minor loop.

2. The interchangeable and adjustable bikini top of claim 1, wherein the first end portion comprises one first loop, and the second end portion comprises one second loop.

3. The interchangeable and adjustable bikini top of claim 1, wherein the at least one strap of the center back accessory comprises at least one slider configured for adjusting the length of the at least one strap.

4. The interchangeable and adjustable bikini top of claim 2, wherein the at least one strap of the center back accessory comprises at least one slider configured for adjusting the length of the at least one strap.

5. The interchangeable and adjustable bikini top of claim 1, wherein the support portion comprises an outer surface and an inner surface;

a first minor loop formed from a first separate piece of material and attached completely on the inner surface of the left side of the support portion, and a second minor loop formed from a second separate piece of material and attached completely on the inner surface of the right side of the support portion;

the center back accessory having a first vertical strap on the left side and a second vertical strap on the right side;

the first vertical strap comprising a first vertical strap end portion, the first vertical strap end portion being connected to a third hook element;

the second vertical strap comprising a second vertical strap end portion, the second vertical strap end portion being connected to a fourth hook element;

the third hook element is reversibly connected to the second minor loop; and, the fourth hook element is reversibly connected to the first minor loop.

6. The interchangeable and adjustable bikini top of claim 1, wherein the support portion comprises two cups;

the support portion and two cups each having an outer surface and an inner surface;

a minor loop formed from a separate piece of material and attached completely on the inner surface of the support portion disposed generally between the two cups; and, the third hook element and fourth hook element are each reversibly connected to the minor loop disposed on the inner surface of the support portion disposed generally between the two cups.

7. The interchangeable and adjustable bikini top of claim 1, wherein the at least one strap of the center back accessory comprises at least one slider configured for adjusting the length of the at least one strap.

8. The interchangeable and adjustable bikini top of claim 5, wherein the at least one strap of the center back accessory comprises at least one slider configured for adjusting the length of the at least one strap.

9. The interchangeable and adjustable bikini top of claim 1, wherein the support portion comprising an outer surface and an inner surface;

a first minor loop formed from a first separate piece of material and attached completely on the inner surface of the left side of the support portion, and a second minor loop formed from a second separate piece of material and attached completely on the inner surface of the right side of the support portion;

the center back accessory having a first vertical strap and a second vertical strap;

the first vertical strap comprising a first vertical strap end portion, the first vertical strap end portion being connected to a third hook element;

the second vertical strap comprising a second vertical strap end portion, the second vertical strap end portion being connected to a fourth hook element;

the third hook element is reversibly connected to a first minor loop of the two minor loops;

the fourth hook element is reversibly connected to a second minor loop of the two minor loops;

wherein the at least one strap of the center back accessory comprises at least one slider configured for adjusting the length of the at least one strap, and wherein the first and second vertical straps of the center back accessory each comprise at least one slider configured for adjusting length of the first and second vertical straps.

10. The interchangeable and adjustable bikini top of claim 6, wherein the at least one strap of the center back accessory comprises at least one slider configured for adjusting the length of the at least one strap, and wherein the first and second vertical straps of the center back accessory each comprise at least one slider configured for adjusting a length of the first and second vertical straps.

* * * * *